US011609036B2

(12) United States Patent
Gunn

(10) Patent No.: US 11,609,036 B2
(45) Date of Patent: Mar. 21, 2023

(54) UNDERCOUNTER APPLIANCE DRAIN PAN

(71) Applicant: ARMORY PRODUCTS, INC., Richmond, VA (US)

(72) Inventor: Matthew M. Gunn, Richmond, VA (US)

( * ) Notice: Subject to any disclaimer, the term of this patent is extended or adjusted under 35 U.S.C. 154(b) by 342 days.

(21) Appl. No.: 17/070,197

(22) Filed: Oct. 14, 2020

(65) Prior Publication Data

US 2021/0116163 A1 Apr. 22, 2021

Related U.S. Application Data

(60) Provisional application No. 62/916,934, filed on Oct. 18, 2019.

(51) Int. Cl.

| | |
|---|---|
| ***F25D 21/14*** | (2006.01) |
| ***D06F 39/12*** | (2006.01) |
| ***A47L 15/42*** | (2006.01) |

(52) U.S. Cl.

CPC ..... *F25D 21/14* (2013.01); *A47L 15/4253* (2013.01); *D06F 39/125* (2013.01); *A47L 15/4212* (2013.01)

(58) Field of Classification Search

CPC .... F16N 31/006; F16N 31/004; F16N 31/002; F16N 31/00; F25D 21/14; F25D 21/00; D06F 39/125; D06F 39/12; B65D 81/261; A47L 15/4253; A47L 15/4251; A47L 15/42; A47L 15/4212; A47L 15/421

USPC ..... 220/571; 137/312; 184/106

See application file for complete search history.

(56) References Cited

U.S. PATENT DOCUMENTS

| | | | | |
|---|---|---|---|---|
| 973,474 | A | 10/1910 | Cameron | |
| 1,487,065 | A | 3/1924 | Irons | |
| 3,353,615 | A | 11/1967 | Nekimken | |
| 4,243,197 | A | 1/1981 | Wright | |
| 5,351,931 | A | 10/1994 | Houben | |
| 5,452,739 | A | 9/1995 | Mustee | |
| 5,865,007 | A | 2/1999 | Bowman | |
| 6,718,993 | B1 | 4/2004 | DeMartini | |
| 6,941,703 | B2 | 9/2005 | MacLean | |
| 8,347,426 | B2 | 1/2013 | Valdenaire | |
| 10,159,396 | B1 * | 12/2018 | Gunn | D06F 39/125 |
| 10,478,039 | B2 | 11/2019 | Gunn | |

(Continued)

FOREIGN PATENT DOCUMENTS

| | | | |
|---|---|---|---|
| EP | 1820432 | A2 | 8/2007 |
| GB | 2244428 | A | 4/1991 |
| JP | H04371675 | A | 12/1992 |

(Continued)

OTHER PUBLICATIONS

International Search Report and Written Opinion for PCT Appl. No. PCT/US2020/055799, dated Jan. 19, 2021, 13 pages.

*Primary Examiner* — Robert J Hicks

(57) ABSTRACT

An appliance drain pan comprises a floor and an upturned rim around an outer edge of the floor. The floor has a first side portion, a second side portion opposite and spaced apart from the first side portion, and a central portion therebetween. A first plurality of raised projections protrudes upward from the first side portion of the floor. A second plurality of raised projections protrudes upward from the second side portion of the floor. Each projection of the first and second plurality of raised projections has a top surface that is substantially parallel to the floor.

20 Claims, 6 Drawing Sheets

(56) References Cited

U.S. PATENT DOCUMENTS

| | | | | |
|---|---|---|---|---|
| 2009/0134301 | A1* | 5/2009 | Dysinger ..... | A47B 91/005<br>248/346.01 |
| 2010/0251646 | A1 | 10/2010 | MacLean | |

FOREIGN PATENT DOCUMENTS

| | | | |
|---|---|---|---|
| JP | 2006112034 | A | 4/2006 |
| JP | 4634237 | B2 | 2/2011 |
| JP | 4866193 | B2 | 2/2012 |

* cited by examiner

UNDERCOUNTER APPLIANCE DRAIN PAN

CROSS-REFERENCE TO RELATED APPLICATIONS

This application claims priority to U.S. Provisional Application Ser. No. 62/916,934, filed Oct. 18, 2019, the contents of which are incorporated herein by reference in its entirety.

FIELD OF THE INVENTION

The present invention relates generally to appliance drain pans.

BACKGROUND OF THE DISCLOSURE

Some household appliances are connected to the household water supply, such as dishwashers, washing machines, standalone icemakers, and refrigerator/freezers with built-in water/ice dispensing. A leak in a water supply line or in the internal plumbing or other components of such an appliance can cause flooding in the house, resulting in significant and expensive property damage.

BRIEF SUMMARY OF THE DISCLOSURE

In one embodiment of the invention, an appliance drain pan comprises a floor and an upturned rim around an outer edge of the floor. The floor has a first side portion, a second side portion opposite and spaced apart from the first side portion, and a central portion therebetween. A first plurality of raised projections protrudes upward from the first side portion of the floor. A second plurality of raised projections protrudes upward from the second side portion of the floor. Each projection of the first and second plurality of raised projections has a top surface that is substantially parallel to the floor.

There may be no projections protruding upward from the center portion of the floor.

The first, second, and center portions of the floor may each extend from a front side of the rim to an opposing back side of the rim.

The first plurality of raised projections may comprise a first sub-plurality of elongated projections whose longitudinal axes are aligned in a front-to-back alignment. The second plurality of raised projections may comprise a second sub-plurality of elongated projections whose longitudinal axes are aligned in a front-to-back alignment.

The first sub-plurality of elongated projections may be arranged in two or more columns of projections with gaps defined between each adjacent pair of columns, and the second sub-plurality of elongated projections may be arranged in two or more columns of projections with gaps defined between each adjacent pair of columns. Gaps may be defined between each adjacent pair of projections in a same column of the first and second sub-plurality of elongated projections. The gaps between adjacent pairs of columns of the first sub-plurality of elongated projections may define a first plurality of water flow paths between the first side portion and the center portion of the floor, and the gaps between adjacent pairs of columns of the second sub-plurality of elongated projections may define a second plurality of water flow paths between the second side portion and the center portion of the floor.

Each projection at each end of each column of the first and second sub-plurality of elongated projections may be affixed to or integral with the rim.

The first plurality of raised projections may comprise a third sub-plurality of elongated projections whose longitudinal axes are aligned at an angle to the longitudinal axes of the first sub-plurality of elongated projections. The second plurality of raised projections may comprise a fourth sub-plurality of elongated projections whose longitudinal axes are aligned at an angle to the longitudinal axes of the second sub-plurality of elongated projections. The aligned angle may be 90 degrees or a different angle.

The third sub-plurality of elongated projections may be arranged in two or more rows of projections with gaps defined between each adjacent pair of rows, and the fourth sub-plurality of elongated projections may be arranged in two or more rows of projections with gaps defined between each adjacent pair of rows.

The first and third sub-pluralities of elongated projections may together define a first plurality of chambers adapted to receive water leaking from an appliance sitting on the drain pan, and the second and fourth sub-pluralities of elongated projections may together define a second plurality of chambers adapted to receive water leaking from an appliance sitting on the drain pan.

The gaps between adjacent pairs of columns of the first sub-plurality of elongated projections and the gaps between adjacent pairs of rows of the third sub-plurality of elongated projections may define a first plurality of water flow paths between the first side portion and the center portion of the floor, such that the first plurality of water flow paths is adapted to enable the received water to flow out of the first plurality of chambers. The gaps between adjacent pairs of columns of the second sub-plurality of elongated projections and the gaps between adjacent pairs of rows of the fourth sub-plurality of elongated projections may define a second plurality of water flow paths between the second side portion and the center portion of the floor, such that the second plurality of water flow paths is adapted to enable the received water to flow out of the second plurality of chambers.

The first sub-plurality of elongated projections may be taller than the third sub-plurality of elongated projections, and wherein the second sub-plurality of elongated projections may be taller than the fourth sub-plurality of elongated projections.

An alternative embodiment of the invention comprises a method of installing an appliance, the appliance comprising a left rear leg, a right rear leg, a left front leg, and a right front leg. The method comprising (a) obtaining an appliance drain pan as described above, (b) positioning the drain pan onto a floor surface where the appliance is to be located, and (c) sliding or lifting the appliance into position on top of the drain pan such that the left rear leg and the left front leg are positioned on the first plurality of raised projections and the right rear leg and the right front leg are positioned on the second plurality of raised projections.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
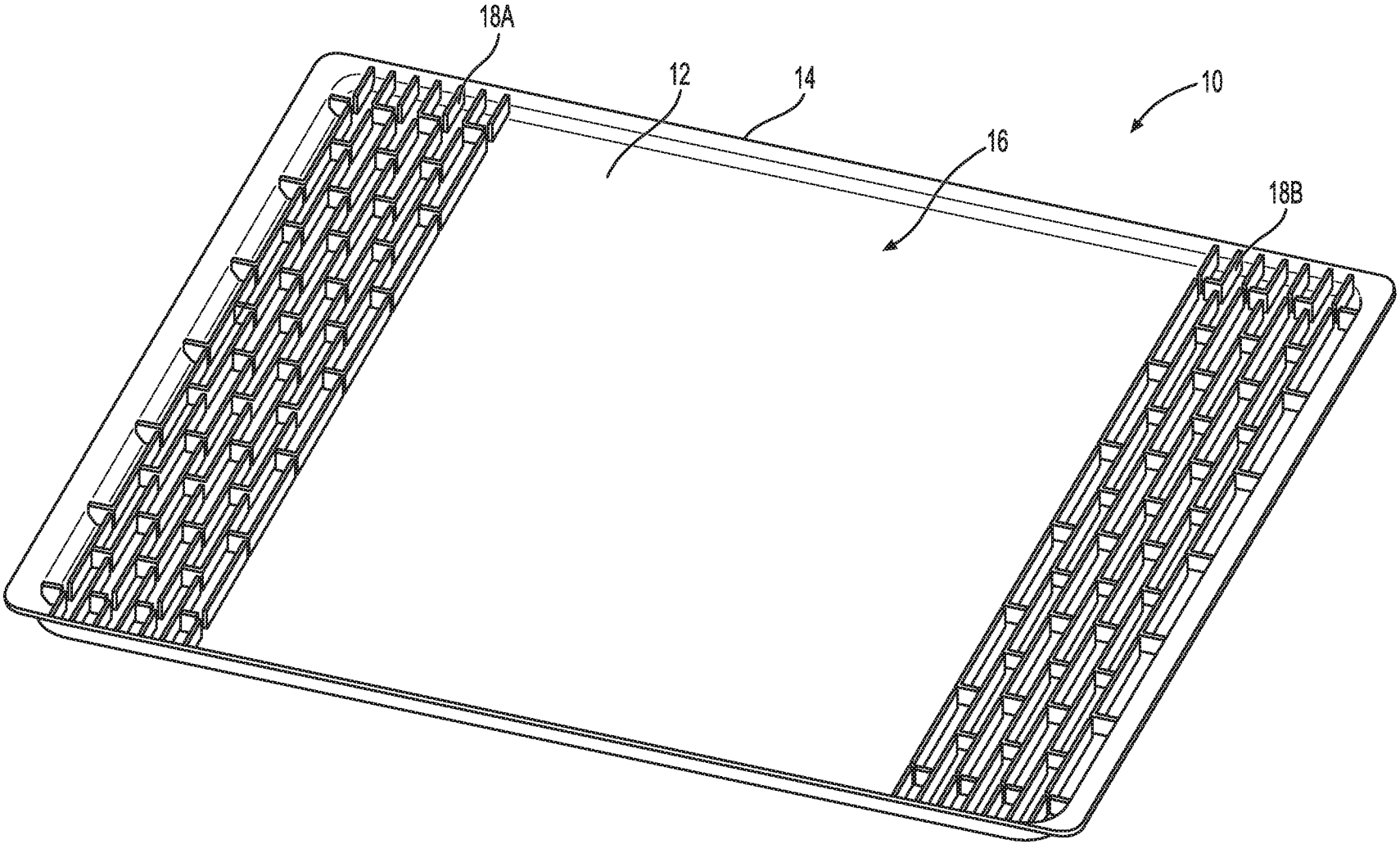
FIG. 1 is a top perspective view of an undercounter appliance drain pan, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise an appliance drain pan that can be used under an undercounter appliance, such as a dishwasher or icemaker (or any other suitable appliance). (The appliance drain pan of embodiments of the invention could also be used with appliances that are not positioned under a counter, such as a washing machine.) The drain pan of embodiments of the invention has a low profile that enables an undercounter appliance to be readily slid into place on top of the drain pan.

Figure 2:
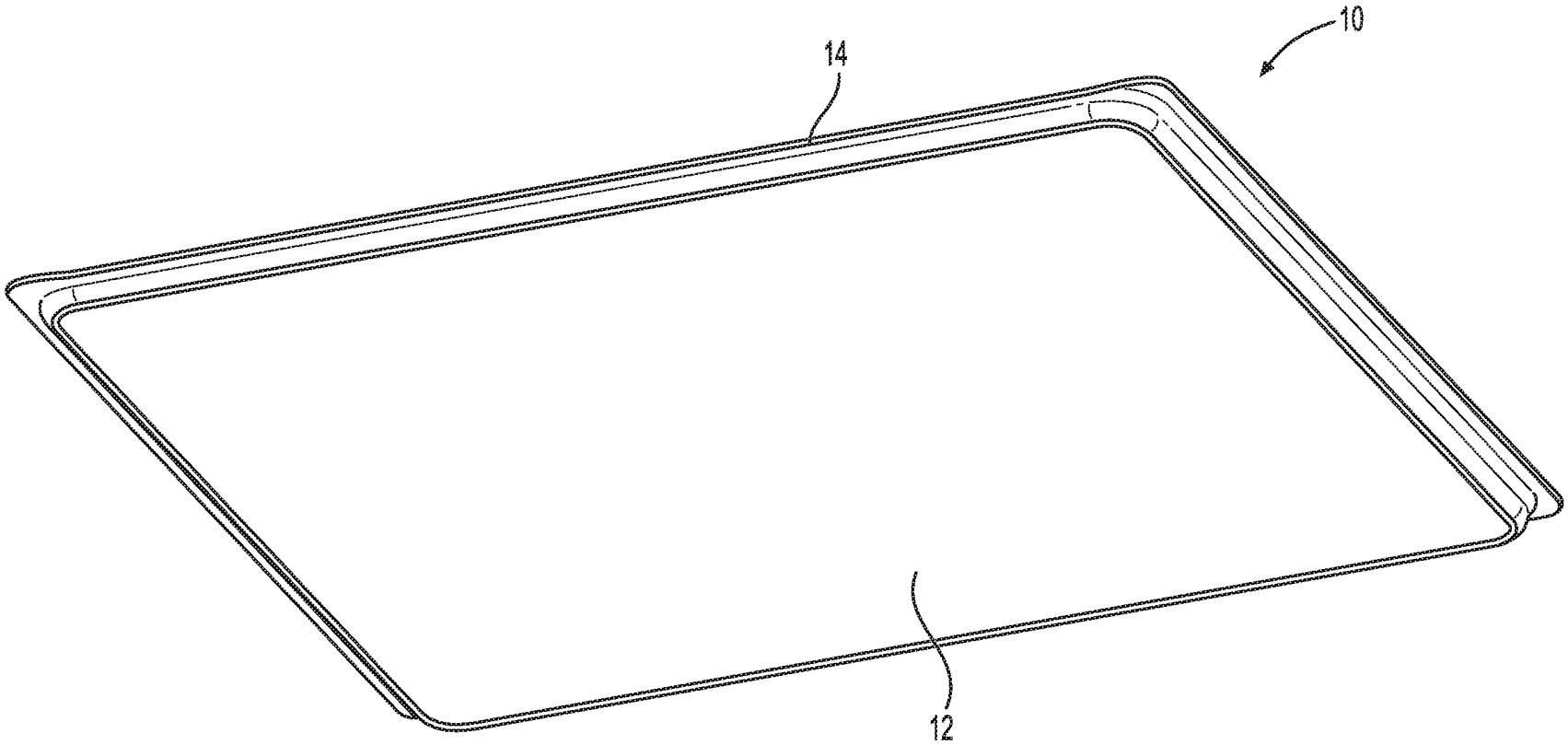
FIG. 2 is a bottom perspective view of the drain pan of FIG. 1.
Figure 3:
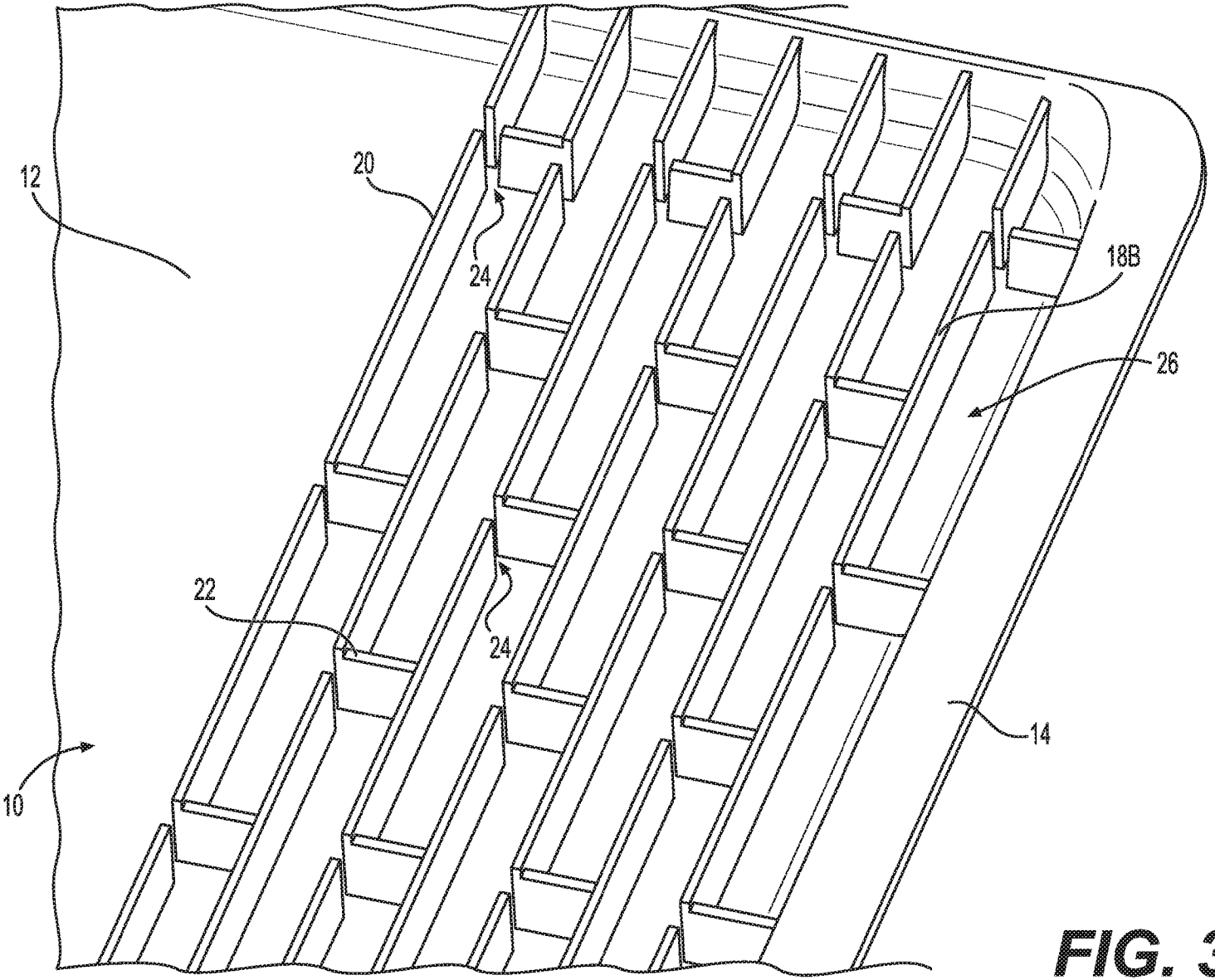
FIG. 3 is a close-up top perspective view of a portion of the drain pan of FIG. 1.

Referring now to FIGS. 1-3, a drain pan 10 of embodiments of the invention has an overall rectangular shape (although may be other suitable shapes, such as square) and may be of any suitable size and shape to fit in the undercounter space and to preferably entirely cover the space below the appliance in order to catch and collect water leaking from the appliance. The drain pan 10 has a generally planar floor 12 surrounded on all sides by an upwardly projecting wall 14, such that a water-holding portion 16 is defined.

On opposing sides of the drain pan, there are groupings of raised, elongated projections 18A, 18B. These projections form raised platforms to support the legs of the appliance, while also providing gaps and spaces to catch and channel water leaking from the appliance.

The wall 14 is tall enough to ensure that any water that leaks into the drain pan is retained in the drain pan (at least until the amount of water leaking exceeds the holding capacity of the drain pan), but short enough to provide the desired low profile of the drain pan to enable the appliance to be lifted into position on the drain pan even with the counter limiting the amount the appliance can be lifted.

During installation, the rear legs of an appliance are lifted over the front wall and lowered onto the respective groupings of raised projections 18A, 18B. The appliance is then slid backward into the undercounter space, with the rear legs of the appliance sliding along respective groupings of raised projections 18A, 18B. The front legs of an appliance are then lifted over the front wall and lowered onto respective groupings of raised projections 18A, 18B, such that the front and rear legs are now sitting on respective groupings of raised projections 18A, 18B.

The raised projections are preferably predominantly oriented front-to-back as illustrated. This front-to-back orientation facilitates the sliding of the appliance legs by reducing the number of side-to-side gaps upon which the appliance legs might snag while sliding.

In the embodiment of FIGS. 1-3, the groupings of raised projections 18A, 18B comprise a plurality of substantially vertical walls 20 arranged in a front-to-back orientation and a plurality of substantially vertical walls 22 arranged in a side-to-side orientation. The vertical walls 20, 22 are preferably vertical, but a small deviation from vertical (e.g., less than about five degrees) is typically tolerable. Each front-to-back wall 20 is affixed to or integral with at least one side-to-side wall 22 and/or the perimeter wall 14, thereby forming angles that help provide strength and rigidity to the walls forming the raised projections. The front-to-back walls 20 may be at 90 degrees to the side-to-side walls 22, or may be at some other angle. Similarly, each side-to-side wall 22 is affixed to or integral with at least one front-to-back wall 20 and/or the perimeter wall 14 to provide the desired right angles. The front-to-back walls 20 and the side-to-side walls 22 define generally rectangular chambers 26 into which water that may be leaking from the appliance may collect. The front-to-back walls 20 and the side-to-side walls 22 are arranged such that the defined rectangular chambers 26 are staggered in what is often called a running bond pattern, although other configurations may be used. The walls 20, 22 forming the raised projections are typically not as tall as the peripheral wall 14 of the drain pan 10, but the raised projections could be of equal height or possibly even taller than the peripheral wall. As seen in FIG. 3, the side-to-side walls 22 may be shorter than the front-to-back walls 20. Having shorter side-to-side walls 22 reduces the likelihood of the appliance legs snagging on the side-to-side walls 22 when the appliance is slid into position on the drain pan 10.

A plurality of gaps 24 are defined among the walls 20, 22 forming the raised projections. These gaps 24 enable water that collects in the rectangular chambers 26 to flow out of the rectangular chambers 26 and into the central part of the water-holding portion 16. The gaps 24 and walls 20, 22 are arranged such that there is a continuous path for water to flow from each of the rectangular chambers 26 into the central part of the water-holding portion 16 (in most cases flowing through other rectangular chambers 26 on the way).

In one exemplary embodiment of the invention, the drain pan of FIG. 1-3 is 24 inches side-to-side, 20.5 inches front-to-back, and 0.63 inches tall, with the raised projections being 0.50 inches tall. In such an exemplary embodiment, the walls forming the raised projections are 0.08 inches thick.

The drain pan 10 of FIGS. 1-3 may be constructed of any suitable material, including any suitable plastic. In one exemplary embodiment of the invention, the drain pan 10 is constructed of polypropylene plastic. The structure of the drain pan 10 of FIGS. 1-3 is well suited to being manufactured by injection molding, however any suitable manufacturing process may be used.

Figure 4:
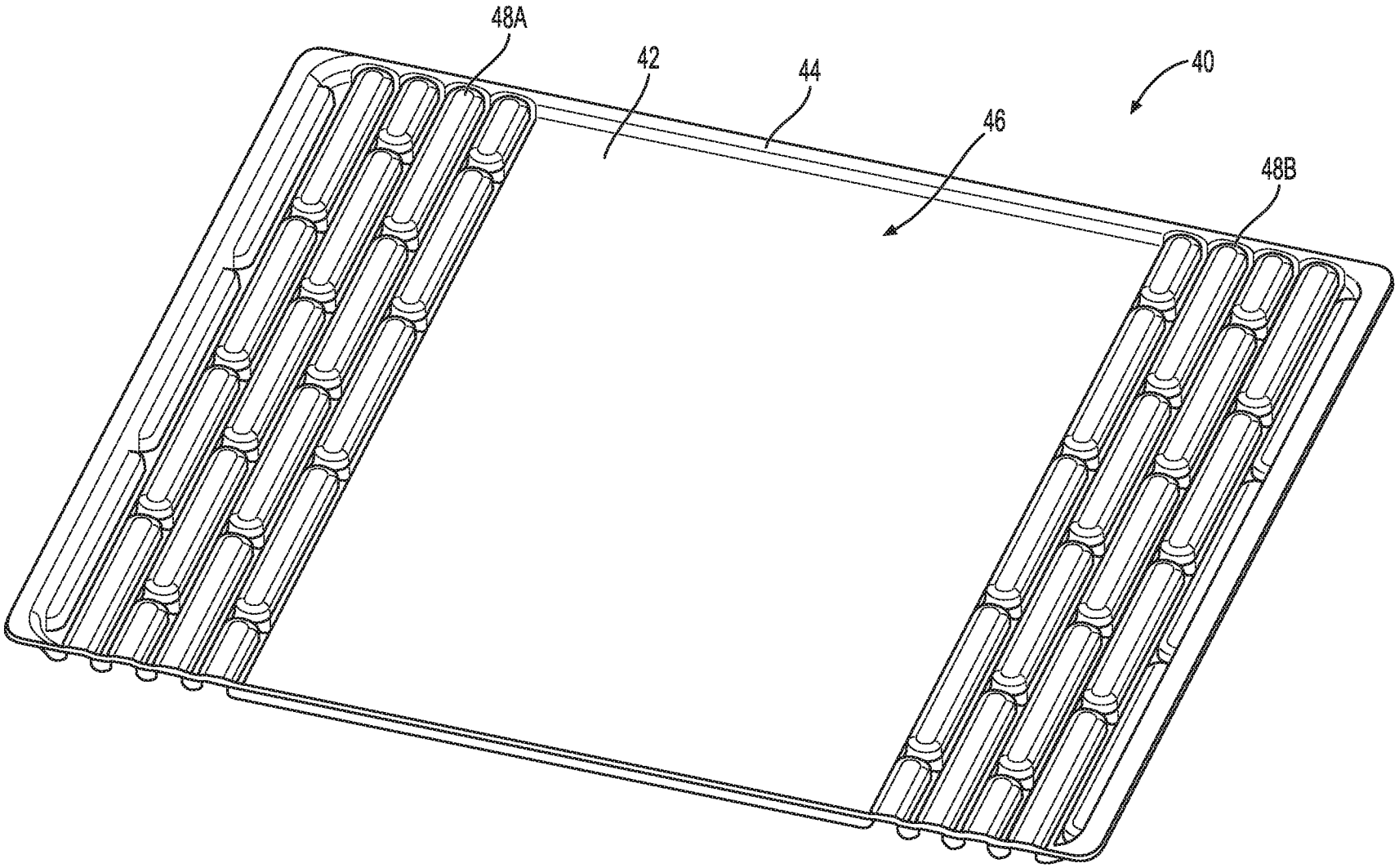
FIG. 4 is a top perspective view of an undercounter appliance drain pan, in accordance with alternative embodiments of the present invention.
Figure 5:
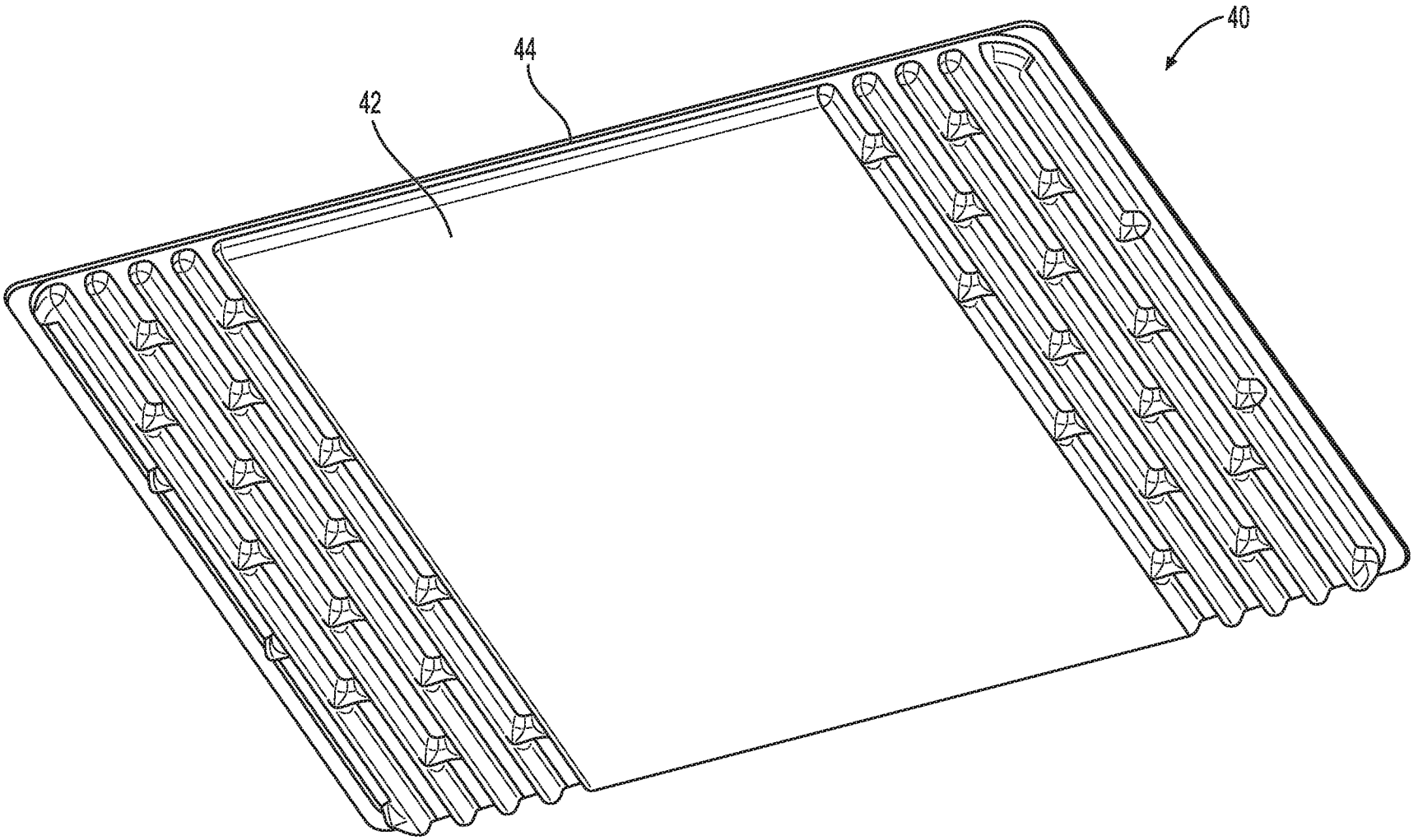
FIG. 5 is a bottom perspective view of the drain pan of FIG. 4.
Figure 6:
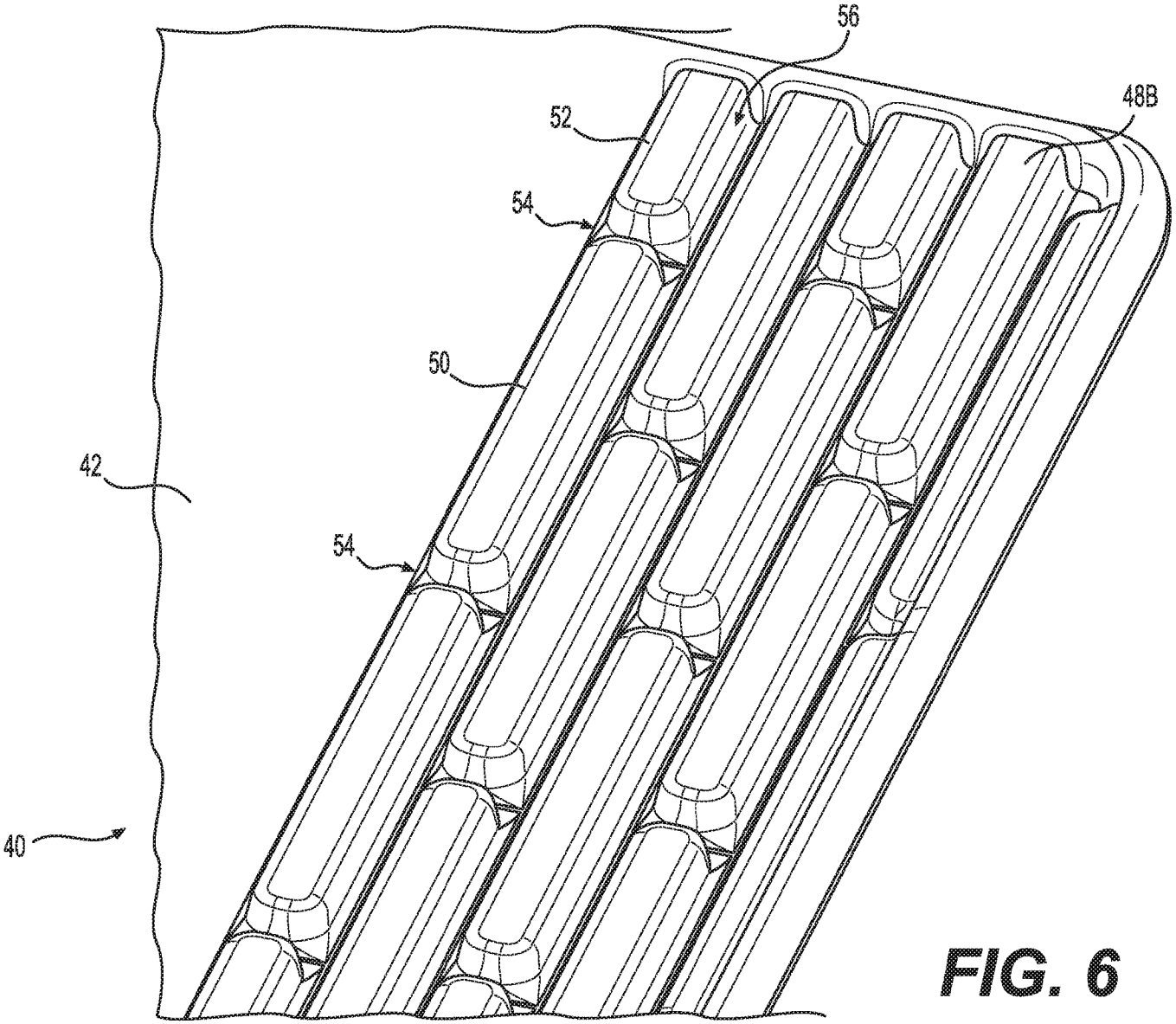
FIG. 6 is a close-up top perspective view of a portion of the drain pan of FIG. 4.

Referring now to FIGS. 4-6, a drain pan 40 of embodiments of the invention has an overall rectangular shape (although may be other suitable shapes, such as square) and may be of any suitable size and shape to fit in the undercounter space and to entirely cover the space below the appliance in order to catch and collect water leaking from the appliance. The drain pan 40 has a generally planar floor 42 surrounded on all sides by an upwardly projecting wall 44, such that a water-holding portion 46 is defined.

On opposing sides of the drain pan, there are groupings of raised, elongated projections 48A, 48B. These projections form raised platforms to support the legs of the appliance, while also providing gaps and spaces to catch and channel water leaking from the appliance.

The wall 44 is tall enough to ensure that any water that leaks into the drain pan is retained in the drain pan (at least until the amount of water leaking exceeds the holding capacity of the drain pan), but short enough to provide the desired low profile of the drain pan to enable the appliance to be lifted into position on the drain pan even with the counter limiting the amount the appliance can be lifted.

During installation, the rear legs of an appliance are lifted over the front wall and lowered onto the respective groupings of raised projections 48A, 48B. The appliance is then slid backward into the undercounter space, with the rear legs of the appliance sliding along respective groupings of raised projections 48A, 48B. The front legs of an appliance are then lifted over the front wall and lowered onto respective groupings of raised projections 48A, 48B, such that the front and rear legs are now sitting on respective groupings of raised projections 48A, 48B.

The raised projections are preferably oriented front-to-back as illustrated. This front-to-back orientation facilitates the sliding of the appliance legs by reducing the number of side-to-side gaps upon which the appliance legs might snag while sliding.

In the embodiment of FIGS. 4-6, the groupings of raised projections 48A, 48B comprise a plurality of ribs 50, 52 arranged in a front-to-back orientation. The ribs 50, 52 have a substantially flat top surface and rounded edges and corners. Gaps 54 are defined between the ends of the ribs and gaps 56 are defined between the sides of the ribs. The top surfaces of the ribs 50, 52 are preferably parallel to the floor 42, but a small deviation from parallel (e.g., slope less than about five degrees) is typically tolerable.

The ribs are staggered in what is often called a running bond pattern, although other configurations may be used. The running bond pattern means that most of the ribs 50 are relatively long but some of the ribs 52 at alternating ends are relatively short.

The ribs 50, 52 forming the raised projections are typically not as tall as the peripheral wall 44 of the drain pan 40, but the raised projections could be of equal height or possibly even taller than the peripheral wall.

The ribs 50, 52 of the drain pan 40 are wider than the walls 20, 22 of the drain pan 10 of FIGS. 1-3. As such, the gaps 54, 56 among the ribs are not able to hold as much water as the rectangular chambers 26 of the drain pan 10 of FIGS. 1-3. The gaps 54, 56 enable water that collects among the ribs to flow out of the gaps and into the central part of the water-holding portion 46. The gaps 54, 56 and ribs 50, 52 are arranged such that there is a continuous path for water to flow from any of the gaps 54, 56 into the central part of the water-holding portion 46 (in most cases flowing through other gaps on the way).

In one exemplary embodiment of the invention, the drain pan of FIGS. 4-6 is 24 inches side-to-side, 20.5 inches front-to-back, and 0.63 inches tall, with the raised projections being 0.50 inches tall. In such an exemplary embodiment, the ribs forming the raised projections are 0.69 inches wide, the longer ribs 50 are 4.71 inches long, and the shorter ribs 52 are 2.1 inches long.

The drain pan 40 of FIGS. 4-6 may be constructed of any suitable material, including any suitable plastic. In one exemplary embodiment of the invention, the drain pan 40 is constructed of polypropylene plastic. The structure of the drain pan 40 of FIGS. 4-6 is well suited to being manufactured by thermoforming, however any suitable manufacturing process may be used.

In addition to the undercounter appliance drain pan, as described above, other embodiments of the invention are directed to corresponding methods for installing an undercounter appliance drain pan as described above and methods for capturing and draining water leaking from an undercounter appliance using the undercounter appliance drain pan described above.

In any of the embodiments of the invention, a drain hole (not illustrated) may be defined in the central portion of the floor. The drain hole may include the necessary fitting to connect a drain hose for directing any captured water to an appropriate household drain or to the outside of the house. The drain pan may be provided without a drain hole, but with instructions for having an installer cut or drill a drain hole in a desired location on the drain pan, thereby enabling the installer to position the drain hole to avoid any obstructions (e.g., joists).

In any of the embodiments of the invention, a water sensor (not illustrated) may be positioned in the water-holding portion to provide an alert if the sensor detects water.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. An appliance drain pan comprising:

a floor having a first side portion, a second side portion opposite and spaced apart from the first side portion, and a central portion therebetween;

an upturned rim around an outer edge of the floor;

a first plurality of raised projections protruding upward from the first side portion of the floor and extending from a front side of the rim to an opposing back side of the rim; and a second plurality of raised projections protruding upward from the second side portion of the floor and extending from the front side of the rim to the opposing back side of the rim;

wherein each projection of the first and second plurality of raised projections has a top surface that is substantially parallel to the floor.

2. The drain pan of claim 1, wherein there are no projections protruding upward from the center portion of the floor.

3. The drain pan of claim 1, wherein the first, second, and center portions of the floor each extend from a front side of the rim to an opposing back side of the rim.

4. The drain pan of claim 1, wherein the first plurality of raised projections comprises a first sub-plurality of elongated projections whose longitudinal axes are aligned in a front-to-back alignment; and wherein the second plurality of raised projections comprises a second sub-plurality of elongated projections whose longitudinal axes are aligned in a front-to-back alignment.

5. The drain pan of claim 4, wherein the first sub-plurality of elongated projections are arranged in two or more columns of projections with gaps defined between each adjacent pair of columns; and wherein the second sub-plurality of elongated projections are arranged in two or more columns of projections with gaps defined between each adjacent pair of columns.

6. The drain pan of claim 5, wherein gaps are defined between each adjacent pair of projections in a same column of the first and second sub-plurality of elongated projections; and wherein the gaps defined between adjacent ones of the first and second sub-plurality of elongated projections in each column are staggered between adjacent columns.

7. The drain pan of claim 6, wherein the gaps between adjacent pairs of columns of the first sub-plurality of elongated projections define a first plurality of water flow paths between the first side portion and the center portion of the floor; and wherein the gaps between adjacent pairs of columns of the second sub-plurality of elongated projections define a second plurality of water flow paths between the second side portion and the center portion of the floor.

8. The drain pan of claim 5, wherein each projection at each end of each column of the first and second sub-plurality of elongated projections is affixed to or integral with the rim.

9. The drain pan of claim 5, wherein the first plurality of raised projections comprises a third sub-plurality of elongated projections whose longitudinal axes are aligned at an angle to the longitudinal axes of the first sub-plurality of elongated projections; and wherein the second plurality of raised projections comprises a fourth sub-plurality of elongated projections whose longitudinal axes are aligned at an angle to the longitudinal axes of the second sub-plurality of elongated projections.

10. The drain pan of claim 9, wherein the longitudinal axes of the third sub-plurality of elongated projections are aligned at 90 degrees to the longitudinal axes of the first sub-plurality of elongated projections; and wherein the longitudinal axes of the fourth sub-plurality of elongated projections are aligned at 90 degrees to the longitudinal axes of the second sub-plurality of elongated projections.

11. The drain pan of claim 9, wherein the third sub-plurality of elongated projections are arranged in two or more rows of projections with gaps defined between each adjacent pair of rows; and wherein the fourth sub-plurality of elongated projections are arranged in two or more rows of projections with gaps defined between each adjacent pair of rows.

12. The drain pan of claim 11, wherein the first and third sub-pluralities of elongated projections together define a first plurality of chambers adapted to receive water leaking from an appliance sitting on the drain pan; and wherein the second and fourth sub-pluralities of elongated projections together define a second plurality of chambers adapted to receive water leaking from an appliance sitting on the drain pan.

13. The drain pan of claim 12, wherein the gaps between adjacent pairs of columns of the first sub-plurality of elongated projections and the gaps between adjacent pairs of rows of the third sub-plurality of elongated projections define a first plurality of water flow paths between the first side portion and the center portion of the floor, such that the first plurality of water flow paths is adapted to enable the received water to flow out of the first plurality of chambers; and wherein the gaps between adjacent pairs of columns of the second sub-plurality of elongated projections and the gaps between adjacent pairs of rows of the fourth sub-plurality of elongated projections define a second plurality of water flow paths between the second side portion and the center portion of the floor, such that the second plurality of water flow paths is adapted to enable the received water to flow out of the second plurality of chambers.

14. The drain pan of claim 9, wherein the first sub-plurality of elongated projections are taller than the third sub-plurality of elongated projections; and wherein the second sub-plurality of elongated projections are taller than the fourth sub-plurality of elongated projections.

15. A method of installing an appliance, the appliance comprising a left rear leg, a right rear leg, a left front leg, and a right front leg, the method comprising:

(a) obtaining an appliance drain pan, the drain pan comprising:

a floor having a first side portion, a second side portion opposite and spaced apart from the first side portion, and a central portion therebetween;

an upturned rim around an outer edge of the floor;

a first plurality of raised projections protruding upward from the first side portion of the floor and extending from a front side of the rim to an opposing back side of the rim; and a second plurality of raised projections protruding upward from the second side portion of the floor and extending from the front side of the rim to the opposing back side of the rim;

wherein each projection of the first and second plurality of raised projections has a top surface that is substantially parallel to the floor;

(b) positioning the drain pan onto a floor surface where the appliance is to be located; and (c) sliding or lifting the appliance into position on top of the drain pan such that the left rear leg and the left front leg are positioned on the first plurality of raised projections and the right rear leg and the right front leg are positioned on the second plurality of raised projections.

16. The method of claim 15, wherein the first plurality of raised projections comprises a first sub-plurality of elongated projections whose longitudinal axes are aligned in a front-to-back alignment;

wherein the second plurality of raised projections comprises a second sub-plurality of elongated projections whose longitudinal axes are aligned in a front-to-back alignment;

wherein the first sub-plurality of elongated projections are arranged in two or more columns of projections with gaps defined between each adjacent pair of columns;

wherein the second sub-plurality of elongated projections are arranged in two or more columns of projections with gaps defined between each adjacent pair of columns;

wherein gaps are defined between each adjacent pair of projections in a same column of the first and second sub-plurality of elongated projections;

wherein the gaps defined between adjacent ones of the first and second sub-plurality of elongated projections in each column are staggered between adjacent columns;

wherein the gaps between adjacent pairs of columns of the first sub-plurality of elongated projections and the gaps between adjacent pairs of projections in each column of the first sub-plurality of elongated projections define a first plurality of water flow paths between the first side portion and the center portion of the floor; and wherein the gaps between adjacent pairs of columns of the second sub-plurality of elongated projections and the gaps between adjacent pairs of projections in each column of the second sub-plurality of elongated projections define a second plurality of water flow paths between the second side portion and the center portion of the floor.

17. The method of claim 16, wherein the first plurality of raised projections comprises a third sub-plurality of elongated projections whose longitudinal axes are aligned at an angle to the longitudinal axes of the first sub-plurality of elongated projections;

wherein the second plurality of raised projections comprises a fourth sub-plurality of elongated projections whose longitudinal axes are aligned at an angle to the longitudinal axes of the second sub-plurality of elongated projections;

wherein the third sub-plurality of elongated projections are arranged in two or more rows of projections with gaps defined between each adjacent pair of rows; and wherein the fourth sub-plurality of elongated projections are arranged in two or more rows of projections with gaps defined between each adjacent pair of rows.

18. The method of claim 17, wherein the longitudinal axes of the third sub-plurality of elongated projections are aligned at 90 degrees to the longitudinal axes of the first sub-plurality of elongated projections; and wherein the longitudinal axes of the fourth sub-plurality of elongated projections are aligned at 90 degrees to the longitudinal axes of the second sub-plurality of elongated projections.

19. The drain pan of claim 17, wherein the first and third sub-pluralities of elongated projections together define a first plurality of chambers adapted to receive water leaking from an appliance sitting on the drain pan;

wherein the second and fourth sub-pluralities of elongated projections together define a second plurality of chambers adapted to receive water leaking from an appliance sitting on the drain pan;

wherein the gaps between adjacent pairs of columns of the first sub-plurality of elongated projections and the gaps between adjacent pairs of rows of the third sub-plurality of elongated projections define a first plurality of water flow paths between the first side portion and the center portion of the floor, such that the first plurality of water flow paths is adapted to enable the received water to flow out of the first plurality of chambers; and wherein the gaps between adjacent pairs of columns of the second sub-plurality of elongated projections and the gaps between adjacent pairs of rows of the fourth sub-plurality of elongated projections define a second plurality of water flow paths between the second side portion and the center portion of the floor, such that the second plurality of water flow paths is adapted to enable the received water to flow out of the second plurality of chambers.

20. The drain pan of claim 17, wherein the first sub-plurality of elongated projections are taller than the third-plurality of elongated projections; and wherein the second sub-plurality of elongated projections are taller than the fourth-plurality of elongated projections.

* * * * *